US011408294B2

(12) United States Patent
Comeau et al.

(10) Patent No.: US 11,408,294 B2
(45) Date of Patent: Aug. 9, 2022

(54) DUAL VOLUTE TURBOCHARGER WITH ASYMMETRIC TONGUE-TO-WHEEL SPACING

(71) Applicant: BorgWarner Inc., Auburn Hills, MI (US)

(72) Inventors: Charles Comeau, Saint-Germain-en-Laye (FR); Craig Colont, Candler, NC (US); Matt Colley, Arden, NC (US)

(73) Assignee: BorgWarner Inc., Auburn Hills, MI (US)

( * ) Notice: Subject to any disclaimer, the term of this patent is extended or adjusted under 35 U.S.C. 154(b) by 0 days.

(21) Appl. No.: 16/496,493

(22) PCT Filed: Mar. 22, 2018

(86) PCT No.: PCT/US2018/023691

§ 371 (c)(1),
(2) Date: Sep. 23, 2019

(87) PCT Pub. No.: WO2018/175678

PCT Pub. Date: Sep. 27, 2018

(65) Prior Publication Data

US 2020/0024988 A1 Jan. 23, 2020

Related U.S. Application Data

(60) Provisional application No. 62/476,174, filed on Mar. 24, 2017.

(51) Int. Cl.
*F01D 9/02* (2006.01)
*F02B 37/02* (2006.01)
(Continued)

(52) U.S. Cl.
CPC ..... *F01D 9/026* (2013.01); *F02B 37/025* (2013.01); *F01D 17/141* (2013.01); *F02B 37/22* (2013.01);
(Continued)

(58) Field of Classification Search
CPC ..... F01D 9/02; F01D 9/026; F01D 17/141; F01D 17/16; F01D 17/165; F02B 37/02;
(Continued)

(56) References Cited

U.S. PATENT DOCUMENTS 4,179,892 A * 12/1979 Heydrich ..... F02B 37/00 60/605.2
4,678,397 A * 7/1987 Komatsu ..... F01D 17/146 415/151
(Continued)

FOREIGN PATENT DOCUMENTS

DE 102013223778 A1 8/2014
GB 2062116 A 5/1981
(Continued)

OTHER PUBLICATIONS

Written Opinion and International Search Report dated Jun. 21, 2018, in International Application No. PCT/US2018/023691.
(Continued)

*Primary Examiner* — Loren C Edwards
(74) *Attorney, Agent, or Firm* — Eric L. Doyle; Stephan A. Pendorf; Patent Central LLC

(57) ABSTRACT

The present invention is related to the housing (60) of an exhaust turbine (32) of a turbocharger comprising a first volute (61) and a second volute (62), each of the volutes (61,62) ending in respective first and second guide tongues (64,66). The gap between the first guide tongue (64) and turbine wheel is smaller than the gap between the second guide tongue (66) and turbine wheel. This tongue asymme-
(Continued)

try allows for control of the pulse amplitude emitted when a blade of the turbine wheel passes by each respective tongue. Moreover, by increasing the wheel-to-tongue distance of only the second guide tongue (66) durability requirements can be met.

14 Claims, 3 Drawing Sheets

(51) Int. Cl.
*F01D 17/14* (2006.01)
*F02B 37/22* (2006.01)

(52) U.S. Cl.
CPC ..... *F05D 2220/40* (2013.01); *F05D 2250/15* (2013.01)

(58) Field of Classification Search
CPC ..... F02B 37/025; F02B 37/22; F02B 37/24; F05D 2220/40; F05D 2250/15
See application file for complete search history.

(56) References Cited

U.S. PATENT DOCUMENTS

| | | | | |
|---|---|---|---|---|
| 2007/0227142 | A1 | 10/2007 | Blaylock et al. | |
| 2014/0230431 | A1 | 8/2014 | Kindl et al. | |
| 2015/0013330 | A1* | 1/2015 | Kindl | F02B 37/22 60/602 |
| 2016/0090857 | A1* | 3/2016 | Blaylock | F01D 9/026 415/146 |

FOREIGN PATENT DOCUMENTS

| | | | | |
|---|---|---|---|---|
| JP | 2010084578 | A | 4/2010 | |
| WO | 2014140598 | A1 | 9/2014 | |
| WO | WO-2015179353 | A1 * | 11/2015 | F01D 25/24 |

OTHER PUBLICATIONS

Japanese Office Action (with English language translation) dated Dec. 28, 2021, in Japanese Application No. JP 2019-552509.

* cited by examiner

DUAL VOLUTE TURBOCHARGER WITH ASYMMETRIC TONGUE-TO-WHEEL SPACING

FIELD OF THE INVENTION

In a multi-cylinder internal combustion engine, in which cylinders are fired sequentially, the exhaust ports, through which the energy for driving a turbine wheel is provided, are opened at different times. When an exhaust port initially opens, a surge of gas is expelled from the cylinder. This high-energy short-duration pulse is of great value in driving the turbine of an exhaust gas turbocharger. Next, as the exhaust port closes, the pressure in the manifold is diminished. In engines equipped with a single manifold, the high-energy pulse from one cylinder traveling down the manifold may meet and combine with the low pressure wave from another cylinder, canceling the pressure pulse. This reduction in the amplitude of the peak pulse pressure reduces turbine driving efficiency.

An improved technique for driving a turbine wheel is known as "pulse charging". The engine exhaust system is divided into two or more exhaust manifolds, each of which is connected to a different set of cylinders, and these independent manifolds feed an internally-divided turbine housing. Thereby, at least first and second flow streams, derived from different groups of cylinders, are kept separated all the way from cylinder exhaust port to turbine wheel, and the high-energy pulses in one manifold are not diminished by interaction with the low pressure waves in the other manifold.

The internally divided housing of a dual volute turbine forms channels, each of which terminating with a so-called tongue. Account has to be taken of the fact that this tongue at least partially prevents optimum flow against the turbine wheel. The tongue conceals a part of the turbine wheel, and flow cannot be directed directly against this part of the turbine wheel. In the case of two channels, there are two such tongues adversely affecting the optimum flow against the turbine wheel. While it might seem desirable for aerodynamic purposes to form the tongue with a slender tip, there is a countervailing requirement for a sufficient thickness to ensure a certain level of endurance strength.

Another problem is that pulse charged turbocharger turbine wheels are exposed to highly unsteady aerodynamic forces, which cause substantial blade vibrations. Aerodynamic blade excitation forces are the main reason for high cycle fatigue of the turbine wheels in turbocharger turbines.

Yet another problem is noise generated by the turbine blades passing the nozzle vanes. The amplitude of the pulse emitted when a blade of the turbine wheel passes by the tongue may translate into noise. This pulse energy may also introduce stresses on the tongue. The tongue is a feature of the turbine housing that is prone to cracking and failure due to thermal stresses and high cycle fatigue, and these pressure pulses introduce additional forces that may accelerate fatigue failure of the tongue.

WO2015179353 (BorgWarner) teaches that, whereas conventionally the tip of the tongue of a first channel is arranged 180° circumferentially offset from the tip of the tongue of a second channel, inventively the risk of blade fatigue failure can be reduced by shortening the circumferential angular offset by at least 5°. However, the problems of nozzle or tongue failure are not addressed, and further improvement in turbine wheel life is desired.

It is an object of the present invention to specify an exhaust-gas turbocharger which, along with cost-effective production and low-maintenance operation, allows pulse charging, is simultaneously compact and can be used in passenger and commercial vehicles.

SUMMARY OF THE INVENTION

In accordance with the present invention, the above-described problems are solved by providing a turbocharger with at least first and second separate flow paths, terminating in first and second guide tongues. The gap between the first guide tongue and turbine wheel is smaller than the gap between the second guide tongue and turbine wheel. This tongue asymmetry allows for control of the pulse amplitude emitted when a blade of the turbine wheel passes by each respective tongue.

The thermodynamic performance of radial and mixed flow turbine stages is increased with the smaller turbine wheel-to-tongue distance at the first guide tongue due to the ability to reduce the leakage of the flow around the turbine wheel as well as being able to harness a greater amount of the energy peaks from flow pulsations emitted by the engine. For maximum thermodynamic performance, the first guide tongue is placed as close as possible to the turbine wheel.

To improve turbine wheel durability, the distance between the second guide tongue and the turbine wheel is made greater than the first, thereby preventing synchronous or otherwise sympathetic responses in the turbine wheel due to the wheel rotating past each tongue.

By increasing the wheel-to-tongue distance of only the second guide tongue, durability requirements can be met, while on the other hand the performance of the first volute terminating in the first tongue would not be needlessly negatively impacted.

The two tongues of a dual volute turbine can either be used as-cast or can be machined to their final shape and placement. The wheel-to-tongue distance of the second tongue can be varied from the first tongue directly in the cast shape, or it can be varied through finish machining operations.

Accordingly, this invention is directed to the design of a low cost turbine flow control device capable of maintaining exhaust gas velocity and pulse energy. The low cost turbocharger is matched to low flow regimes to provide optimized turbo (and thus engine) transient response for low flow while being capable of delivering the high flows demanded by the engine in other than low flow conditions, in the same, cost-effective turbocharger.

BRIEF DESCRIPTION OF THE FIGURES

The present invention is illustrated by way of example and not limitation in the accompanying drawings in which like reference numbers indicate similar parts, and in which.

DETAILED DESCRIPTION OF THE INVENTION

Pulse charged turbines are well known. U.S. Pat. No. 8,621,863 (KRÄTSCHMER et al), the disclosure of which is incorporated herein by reference, shows in FIG. 5 a schematic representation of an internal combustion engine fitted with a turbocharger. In principle, the internal combustion engine may be a diesel, an SI or a diesel/SI engine; in the illustrated embodiment, it has six cylinders, of which cylinders a first set of three are combined to form a first cylinder group and a second set of three cylinders are combined to form a second cylinder group. The two exhaust gas lines are assigned to the respective cylinder groups, the first exhaust gas line being coupled to the first spiral passage of the turbocharger, which is designed as a partial volute, via suitable manifolds, while the second exhaust gas line is coupled to the second spiral passage designed as a full volute.

Figure 1:
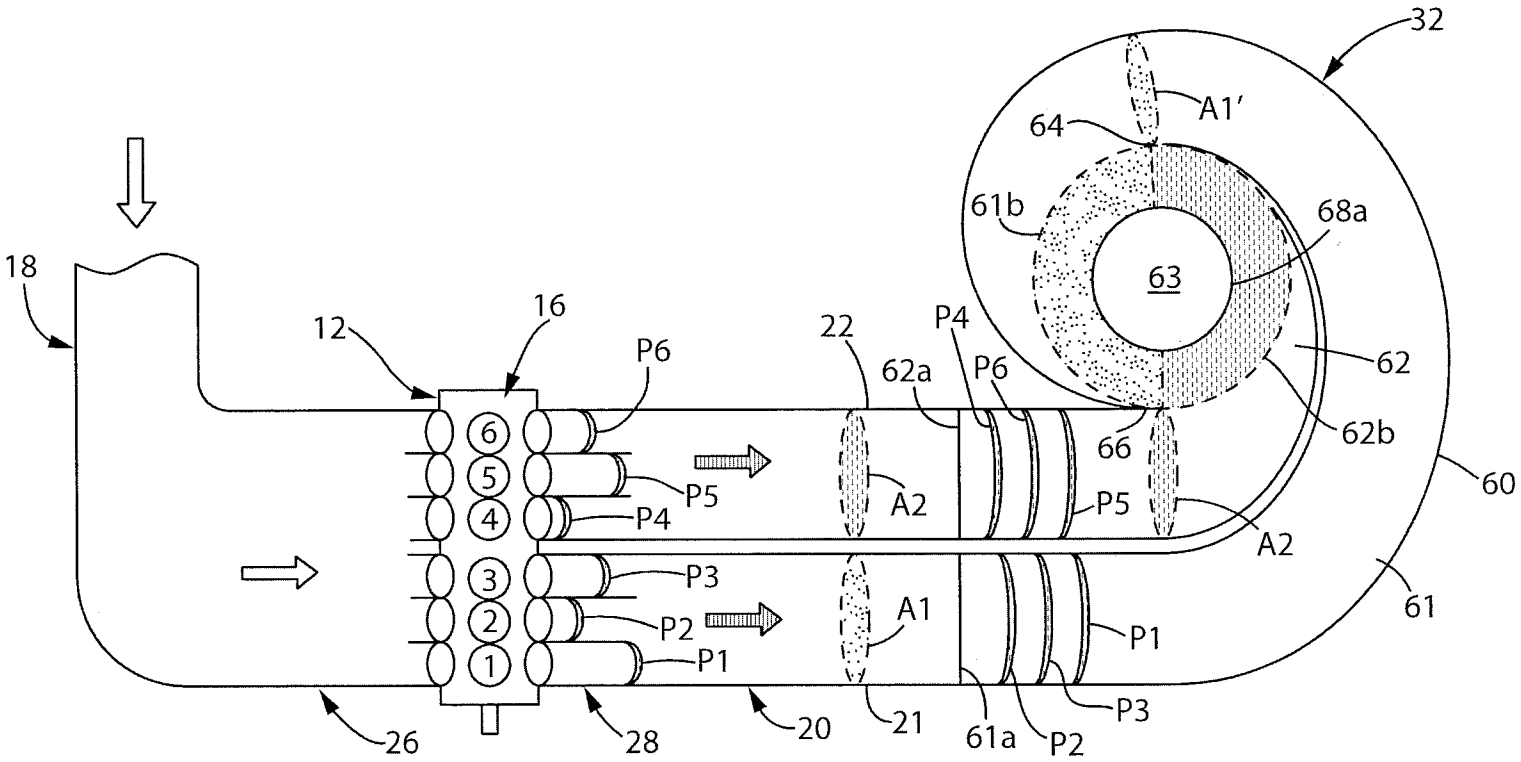
FIG. 1 provides an overview of the exhaust gas flow to the exhaust turbine of the turbocharger.
Figure 2:
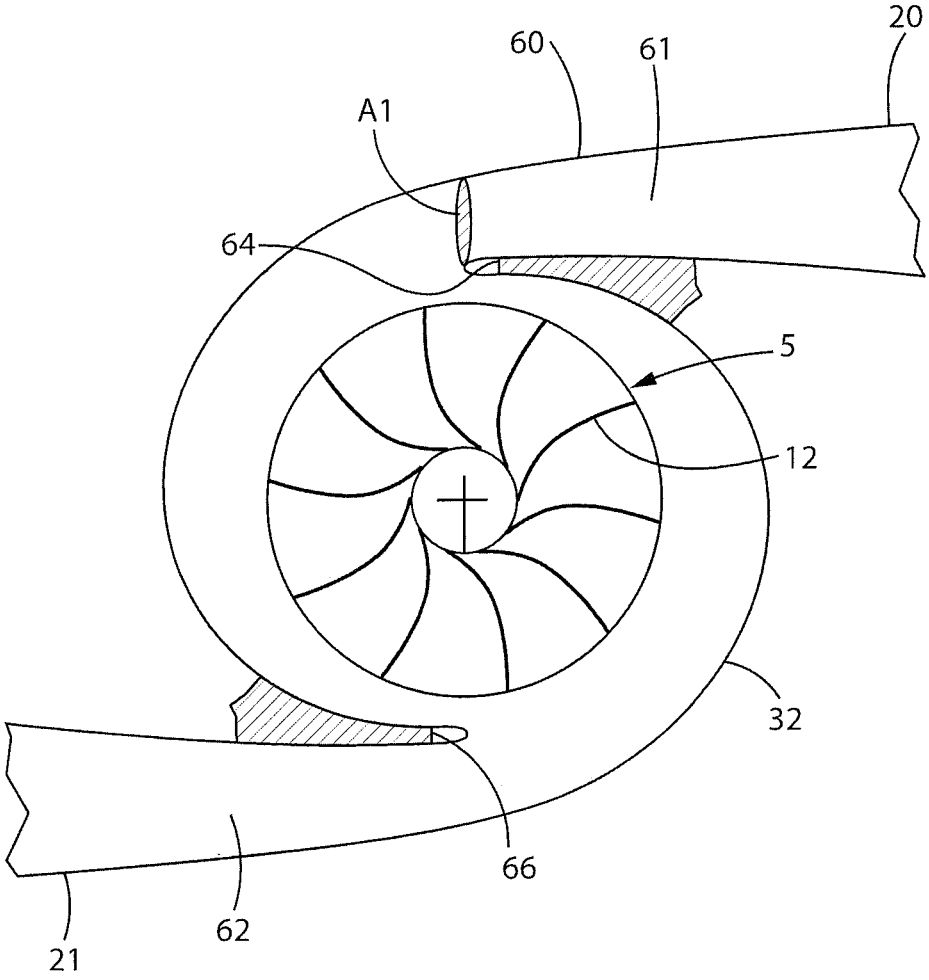
FIG. 2 illustrates a first embodiment of the invention with a dual entry turbine housing.

FIG. 1 of the present application is adapted from FIG. 2 of US Application Publication 20160025044, the disclosure of which is incorporated herein by reference. FIG. 1 provides an overview of the intake manifold 26 leading to combustion chambers 16 and exhaust gas flow from the combustion chambers 16 to the exhaust turbine 32 of the turbocharger. The internal combustion engine 12 system includes an intake passageway 18 with an intake manifold, and exhaust manifold 20 for conducting exhaust gas pulses 28. The intake passageway 18 is in fluid communication with the combustion chambers 16 to supply intake air to the combustion chambers 16. The exhaust manifold 20 is in fluid communication with the combustion chambers 16 to receive exhaust gas discharged through exhaust ports to the outside of the combustion chambers 16.

Exhaust flow from cylinders #1, #2 and #3 of the combustion chambers 16 is physically separated from the exhaust flow from cylinders #4, #5 and #6 of the combustion chambers 16. In particular, the exhaust gas from the cylinders #1, #2 and #3 of the combustion chambers 16 flow into the first exhaust pipe 21, while the exhaust gas from the cylinders #4, #5 and #6 of the combustion chambers 16 flow into the second exhaust pipe 22. While the engine 12 is running, exhaust gas pulses P1 to P6, which are produced as the exhaust valves open and close, propagate out from the cylinders #1, #2, #3, #4, #5 and #6, respectively. Exhaust pulse interference conventionally occurs when the exhaust gas pulses from one cylinder meet the low pressure wave from another cylinder. By separating the exhaust gas from the cylinders #1, #2, #3, #4, #5 and #6 into the first and second exhaust pipes 21, 22, as discussed above, the exhaust turbine 32 can efficiently utilize exhaust scavenging techniques, which improves turbine system performance and reduces turbo lag.

The exhaust turbine 32 of the turbocharger has a turbine housing 60 having a first volute 61, a second volute 62 and a turbine wheel receiving bore 63 (also known as a base circle). The first volute 61 has a first volute exhaust gas inlet 61*a* with a cross sectional area A1. Here, the first volute exhaust gas inlet 61*a* receives a stream of commingled exhaust gases from the cylinders #1, #2 and #3. The first volute 61 has a first exhaust gas outlet 61*b* with a cross sectional area A1' at the beginning of the first exhaust gas outlet 61*b*, which extends circumferentially from a tip or free end of a first tongue 64 to a tip or free end of a second tongue 66 in a counterclockwise direction as illustrated in FIG. 1. The second volute 62 has a second exhaust gas inlet 62*a* with a cross sectional area A2. Here, the second exhaust gas inlet 62*a* receives a stream of commingled exhaust gases from the cylinders #4, #5 and #6. The second volute 62 has a second exhaust gas outlet 62*b* with a cross sectional area A2' at the beginning of the second exhaust gas outlet 62*b*, which extends circumferentially from the tip end of a second tongue 66 to the tip end of the first tongue 64 in a counterclockwise direction as illustrated in FIG. 1. The cross sectional areas A1 and A2 of the first and second volutes 61 and 62 can be substantially the same. Alternatively, the cross sectional area A2 of the second volute 62 can be smaller than the cross sectional area A1 of the first volute 61.

As diagrammatically illustrated in FIG. 1, the first exhaust gas outlet 61*b* opens circumferentially along 180 degrees of the turbine receiving bore 63, while the second exhaust gas outlet 62*b* circumferentially opens along the remaining 180 degrees of the turbine receiving bore 63.

In accordance with the present invention, a turbocharger is provided with at least first and second separate flow paths, terminating at second and first guide tongues. The gap between the first guide tongue and turbine wheel is smaller than the gap between the second guide tongue and turbine wheel. This tongue asymmetry allows for control of the pulse amplitude emitted when a blade of the turbine wheel passes by each respective tongue.

Figure 3:
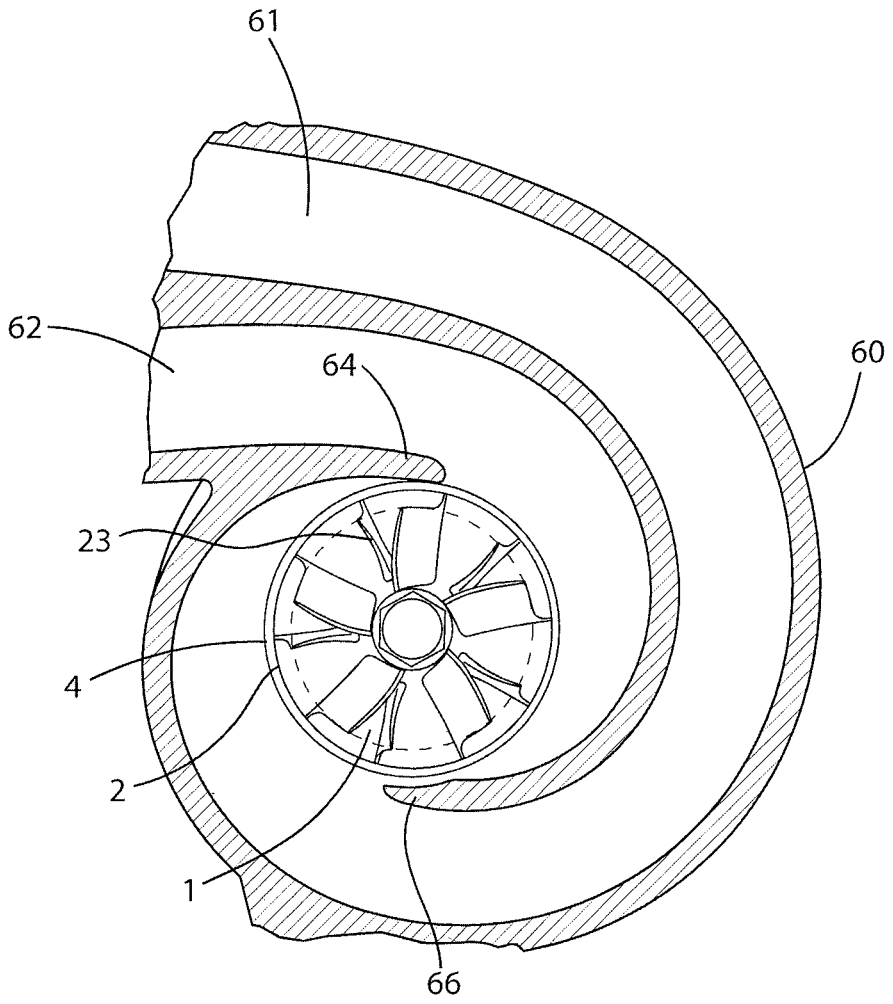
FIG. 3 illustrates a second embodiment of the invention with a divided turbine housing.

The turbine housing consists of a plurality (two or more) of volutes 61, 62 configured such that the exits of each volute are arranged around the base circle of the turbine housing. The volutes cumulatively deliver exhaust air to the circumference 2 of the turbine wheel 1 including turbine blades 23 mounted thereon as shown in FIGS. 2 and 3.

The typical method to define tongue gap is the wheel-to-tongue gap at the closest point divided by the wheel diameter (measured at radially outer tips of the turbine wheel). For example, a 3 mm gap divided by a 53 mm wheel diameter=3/53=5.6% or 0.056 tongue gap ratio (TGR). The dual volute pulse effect tapers off as the tongue gap increases. The TGR of the larger gap is selected in the range 0.15-0.04, preferably in the range 0.1-0.05, more preferably in the range 0.08-0.05, most preferably 0.07-0.06. The TGR of the closer gap may be selected in the range 0.08-0.01, preferably 0.07-0.02, more preferably 0.06-0.03, most preferably 0.05-0.04. The ratio of the larger TGR to the smaller TGR may be from 1.5 to 4, preferably 2-3.

The asymmetric tongue spacing can be used in a turbocharger with symmetric or with asymmetric volutes. It can be used in a turbocharger with EGR. It can be used in a turbocharger with variable turbine geometry (VTG). The essential feature of the present invention is the asymmetric tongue-to-wheel spacing. It can be used in a dual entry turbine wherein an actuator is used for selectively controlling the flow of exhaust gases from the inlet to a second scroll while maintaining flow of such gases to a first scroll, as disclosed for example in U.S. Pat. No. 4,389,845 (Koike). See FIG. 9B in which an actuator controls a valve which controls the flow into the first or second and first volutes formed by a solid divider wall. The asymmetric tongue spacing can also be used with either radial flow turbines or "mixed flow" radial/axial turbines (see US 2007/0180826).

As an alternative to varying the tongue-to-wheel distance between first and second tongues, it is also possible to varying the nozzle width of the first volute relative to the second volute.

This method of asymmetry involving varying the nozzle width of of the first volute from the second volute allows for an adjustment of the flow quantity between both volutes. This method could be used to equalize the turbine inlet pressure of both cylinder groups. This could be used to counteract the asymmetry found in the cylinder head designs. For example, in a situation where the nozzle width of the first volute and the second volute are equal the turbine inlet pressure could be measured in each volute (and so in each cylinder pairing). In this example the pressure entering the second volute is below the target for operation on the engine. The nozzle width of the second volute could be decreased to decrease the flow through the second volute and so increase the turbine inlet pressure.

Decreasing the flow in one volute could be useful for increasing the low end torque and transient performance potential of a turbine stage. A lower flowing turbine stage can provide more power to the compressor stage at lower engine flows and engine RPM which enables for more aggressive low end torque and transient operation.

This method could be used to create unequal flow between cylinder groups which would create an unequal turbine inlet pressure in each volute. In a situation where the nozzle width of a first volute and nozzle width of a second volute are symmetric the turbine inlet pressure could be measured in each volute (and so in each cylinder pairing) and be found to be equal. For purposes of driving HP-EGR the nozzle width of the second volute could be reduced to increase the turbine inlet pressure ahead of the second volute. Increasing the turbine inlet pressure of the second volute would enable the turbo/engine system to drive HP-EGR without impacting the pumping loop/VE of the cylinder grouping of the first volute.

We claim:

1. A turbocharger turbine housing (60) in a form of a spiral casing having at least first and second volutes (61, 62) defining separate flow paths to a turbine wheel bore (63), the turbine wheel bore (63) adapted to receive a turbine wheel (1) having a turbine wheel circumference (2), the flow paths ending with a first and a second guide tongue, respectively (64, 66), wherein a gap between the first guide tongue (64) and the turbine wheel (1) circumference (2) is smaller than a gap between the second guide tongue (66) and the turbine wheel circumference (2), wherein a tongue-to-gap ratio (TGR) of the second guide tongue (66), measured as wheel-to-tongue gap at the closest point divided by the wheel diameter, is fixed from the range of 0.15-0.04, a TGR of the first guide tongue (64) is fixed in the range of 0.08-0.01, and a ratio of the larger TGR to the smaller TGR is fixed from the range of 1.5 to 4.

2. The turbocharger turbine housing as claimed in claim 1, wherein the TGR of the second guide tongue (66) is fixed from the range of 0.1-0.05.

3. The turbocharger turbine housing as claimed in claim 1, wherein the TGR of the second guide tongue (66) is fixed from the range of 0.08-0.05.

4. The turbocharger turbine housing as claimed in claim 1, wherein the TGR of the second guide tongue (66) is fixed from the range of 0.07-0.06.

5. The turbocharger turbine housing as claimed in claim 1, wherein the TGR of the first guide tongue (66) is fixed from the range of 0.07-0.02.

6. The turbocharger turbine housing as claimed in claim 1, wherein the TGR of the first guide tongue (66) is fixed from the range of 0.06-0.03.

7. The turbocharger turbine housing as claimed in claim 1, wherein the TGR of the first guide tongue (66) is fixed in the range of 0.05-0.04.

8. The turbocharger turbine housing as claimed in claim 1, wherein the ratio of the larger TGR to the smaller TGR is fixed from the range of 2-3.

9. A cast turbocharger turbine housing (60) in a form of a spiral casing having at least first and second volutes (61, 62) defining separate flow paths to a turbine wheel bore (63), the turbine wheel bore (63) adapted to receive a turbine wheel (1) having a turbine wheel circumference (2), the flow paths ending with a first and a second guide tongue, respectively (64, 66), wherein a gap between the first guide tongue (64) and the turbine wheel (1) circumference (2) has a first wheel-to-tongue distance (D1), a gap between the second guide tongue (66) and the turbine wheel circumference (2) has a second wheel-to-tongue distance (D2), wherein the first wheel-to-tongue distance (D1) is smaller than the second wheel-to-tongue distance (D2), and wherein the first wheel-to-tongue distance (D1) and the second wheel-to-tongue distance (D2) are produced by casting or by machining of the cast turbine housing.

10. The turbocharger turbine housing as claimed in claim 9, wherein the first and second volutes are asymmetric.

11. The turbocharger turbine housing as claimed in claim 10, wherein one of the at least first and second volutes is connected to an exhaust gas recirculation line.

12. The turbocharger turbine housing as claimed in claim 9, wherein the turbine housing houses a variable geometry turbine.

13. The turbocharger turbine housing as claimed in claim 9, wherein said first and second guide tongues (64, 66) have tips, and wherein the first guide tongue tip is offset 180° circumferentially from the second guide tongue tip.

14. The turbocharger turbine housing as claimed in claim 9, wherein the first and second guide tongues (64, 66) have tips, and wherein the first guide tongue tip is offset 165°-177° circumferentially from the second guide tongue tip.

* * * * *